United States Patent [19]

Fisher

[11] Patent Number: 4,901,517

[45] Date of Patent: Feb. 20, 1990

[54] APPARATUS FOR THE DRAFTING SECTION OF RING SPINNING FRAMES

[75] Inventor: Don E. Fisher, Pensacola, Fla.

[73] Assignee: Monsanto Company, Pensacola, Fla.

[21] Appl. No.: 380,944

[22] Filed: Jul. 17, 1989

[51] Int. Cl.[4] ..... D01H 5/26; D01H 5/86

[52] U.S. Cl. ..... 57/315; 19/244; 19/249; 19/252; 57/362

[58] Field of Search ..... 57/315, 362, 200, 252, 57/254; 19/244, 249, 252, 253, 256

[56] References Cited

U.S. PATENT DOCUMENTS

| | | | |
|---|---|---|---|
| 1,213,744 | 1/1917 | Casablancas | 19/253 X |
| 2,694,836 | 11/1954 | Peuto | 19/249 |
| 2,716,779 | 9/1955 | Reynolds | 19/253 |
| 2,751,631 | 6/1956 | Hunter et al. | 19/253 |
| 3,331,104 | 7/1967 | Field, Jr. | 19/244 |
| 4,290,170 | 9/1981 | Brookstein et al. | 57/315 X |
| 4,520,532 | 6/1985 | Stalder et al. | 19/244 |

*Primary Examiner*—John Petrakes

*Attorney, Agent, or Firm*—John W. Whisler

[57] ABSTRACT

An improved apparatus for the drafting section of ring spinning frames is disclosed. The apparatus includes a front cot roll apron which permits the apparatus to be operated at higher than normal draft ratios without sacrificing spinning performance or product uniformity.

7 Claims, 1 Drawing Sheet

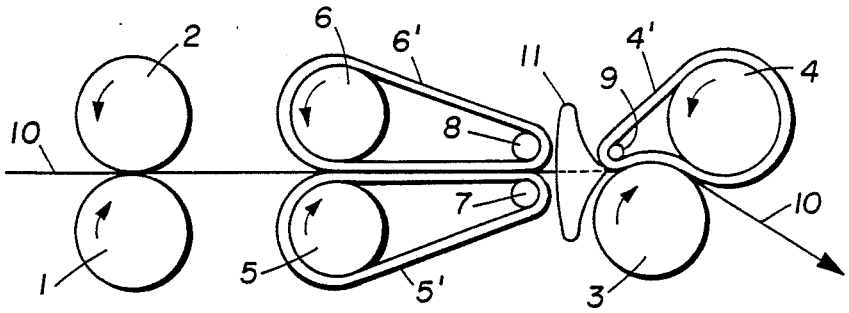
2
6
6'
11
4'
4
9
10
8
7
10
1
5
5'
3

APPARATUS FOR THE DRAFTING SECTION OF RING SPINNING FRAMES

BACKGROUND OF THE INVENTION

A. Field of the Invention

This invention relates to ring spinning frames for processing staple fibers in the form of a continuous strand of loosely assembled crimped staple fibers with little twist (roving) or no twist (silver) to provide twisted yarn. For convenience, the term "sliver", as used herein, includes roving which is an intermediate state between sliver and yarn. More particularly, the invention relates to an improved apparatus for the drafting section of ring spinning frames whereby improved spinning performance in terms of breaks ("ends down") per 1000 spindle hours and more uniform yarns can be achieved without sacrificing productivity.

B. Description of the Prior Art

Ring spinning frames and their operation are well-known in the art. Conventional ring spinning frames comprise a plurality of individual spinning positions or stations, each having a drafting section for drafting a sliver to a desired size (e.g. cotton count), an upright rotatable spindle for inserting twist in the sliver and a ring-and-traveler take-up mechanism for winding the twisted sliver (yarn) onto a bobbin mounted on the spindle.

The drafting section comprises a pair of rear nip rolls for metering the input of the sliver and a pair of front nip rolls for drafting the sliver. One roll of each pair is a cot roll and the other roll is a serrated metal roll. The distance between the nip of the rear rolls and the nip of the front rolls is slightly greater than the length of the staple fibers in their extended configuration so that the individual fibers of the sliver are not stretched during drafting. The front rolls are operated at a peripheral speed considerably greater than that of the rear rolls. The drafting section also includes a drafting control means typically comprising a pair of rotatable aprons (e.g. a Casablanca apron system) positioned between the rear rolls and front rolls. The aprons are operated at a peripheral speed slightly greater than that of the rear rolls so as to control and straighten out the fibers of the sliver. However, during operation of the drafting section, a region of the sliver approximately 1.25 inches (3.18 cm) in length extending from the exit end of the aprons to the nip of the front rolls is not controlled. Instead of using aprons as the drafting control means, one or more pair of nip rolls may be used. A free-floating, funnel-shaped piece (condenser) through which the sliver passes during operation of the frame is positioned between the drafting control means and the front rolls to condense the sliver fibers into a narrow ribbon as the sliver approaches the front rolls.

In commercial practice of ring spinning frames, the spindle is operated at its highest practical mechanical speed (rpm) and the front rolls are operated at a peripheral speed that will insert the desired twist into the sliver. The rear rolls are then operated at a peripheral speed such that the ratio of the peripheral speed of the front rolls to that of the rear rolls (i.e. draft ratio) does not exceed 28:1. Under the foregoing conditions satisfactory processing of the sliver in terms of ends down and product uniformity in terms of thick and thin regions along the length of the resulting product yarn. However, as the draft ratio is increased from a value of 28:1, the yarn becomes increasingly less uniform (i.e. has more thick and thin regions) and sliver breaks become more frequent until the process can no longer be run.

SUMMARY OF THE INVENTION

The present invention provides an improved apparatus for the drafting section of conventional ring spinning frames which substantially improves spinning performance, provides more uniform yarns and permits the use of high draft ratios and heavier slivers and also permits finer size yarns to be spun. Surprisingly, draft ratios significantly higher than 28:1 can be used without sacrificing spinning performance or yarn uniformity. The improved apparatus consists of the previously described conventional drafting apparatus modified to include a front cot roll apron which extends around and in contact with the front cot roll and at least one other elongated member, such as a cylindrical pipe, pin or roll. The other member(s) is positioned between the front cot roll and the drafting control means (e.g. Casablanca aprons). The member(s) and front cot roll are of a size and arranged with respect to one another so that the front cot roll apron follows the contour of the front serrated metal roll ahead of the nip and provides a friction area between the front roll cot apron and front metal roll which straightens out the fibers and delivers the fibers to the front roll in their straightened out form. The front cot roll apron functions in a manner similar to the Casablanca apron system in that the apron exerts enough pull and compressive force on the fibers to straighten out the fibers (remove crimp therefrom) and yet permits the fibers to slip without stretching. The front cot roll in effect controls the fibers from the time they leave the Casablanca aprons until they reach the nip of the front rolls by gently pulling on fibers which have not yet been released by the nip of the rear rolls or casablanca aprons. The front cot roll apron of the present invention essentially eliminates the uncontrolled region of sliver length between the exit end of the Casablanca aprons and the nip of the front rolls.

The front cot roll apron may be used in the drafting section of long or short staple ring spinning frames and may be retrofitted to the drafting section of existing frames or made a part of the drafting section of new frames to process sliver composed of short or long crimped staple fibers. The staple fibers may be natural fibers, such as wool and cotton, or synthetic fibers such as fiber made from nylon, polyester, polyolefin acrylic polymer, etc. and the crimp may be natural or chemically or mechanically imparted thereto (e.g. stuffer box crimp). By long staple is meant staple having a length of at least 6.0/15.2 inches/cm (6.5/16.5 inches/cm to 9.0/22.9 inches/cm) and by short staple is meant staple having a length of less than six inches 6.0/15.2 inches/cm (e.g. 0.3/0.8 to 4.0/10.2 inches/cm).

The drafting apparatus of the present provides an improvement in conventional long and short staple ring spinning processes which permits more uniform staple yarns to be spun, higher draft ratios to be used, heavier slivers to be used and/or finer count staple yarns to be spun. The use of heavier grain slivers reduces the cost of supplying sliver.

BRIEF DESCRIPTION OF THE DRAWING

The FIGURE is a schematic representation of an apparatus for the drafting section of conventional ring spinning frames to which has been added a front cot roll apron in accordance with the present invention.

DESCRIPTION OF THE PREFERRED EMBODIMENTS

The drafting apparatus of the present differs from the drafting apparatus of conventional short and long staple ring spinning frames, in that, it includes a special front cot roll apron arrangement. Referring to the FIGURE, sliver 10 consisting of loosely assembled crimped staple fibers without twist is passed between two pair of nip rolls 1,2 and 3,4, the peripheral speed of the front rolls 3,4 is considerably greater than that of the back rolls 1,2 and the distance between the pair of rolls is in excess of the maximum staple fiber length. Rolls 2 and 4 are idler cot rolls and rolls 1 and 3 are driven serrated metal rolls. Rear rolls 1,2 meter the input of sliver 10 and front rolls 3,4 draft sliver 10. A drafting control means having aprons 5' and 6' is located between the back rolls and front rolls for forwarding, guiding and controlling sliver 10. Apron 5' passes over driven roll 5 and fixed bar 7 and apron 6' passes over driven roll 6 and fixed bar 8. Aprons 5' and 6' move at a slightly greater speed (e.g. 1.1 times greater) than that of back rolls 1,2. Aprons 5' and 6 press on sliver 10 with sufficient force to straighten out the crimp in the fibers of sliver 10 and permit the fibers to slip without stretching. Front cot roll apron 4' is unique to the drafting apparatus of the present invention. Apron 4' passes over front cot roll 4, follows the contour of front metal roll 3 for a short distance and then passes around fixed bar 9. (Instead of fixed bars 7, 8 and 9 idler rolls can be employed.) The rolls and aprons on conventional ring spinning frames are adjustable so as to accommodate different length staple fibers and permit quick and easy maintenance (e.g. changing) of the rolls and aprons.

In operation of the apparatus during ring spinning a free-floating condenser 11 previously described is used so that the sliver is in the configuration of a narrow ribbon at the time it reaches the nip of the front rolls Front cot roll apron 4' guides and controls the sliver fibers from the time the fibers leave the condenser until the fibers are nipped by front rolls 3, 4. Apron 4' provides a friction area between apron 4' and metal roll 3 where the crimp is straightened out of the fibers (removed) and the fiber are permitted to slip without stretching. This function of apron 4' permits draft ratios in excess of 28:1 to be used without producing alternating thick and thin regions along the length of the sliver and an increase in sliver breaks. The drafted sliver after leaving the nip of front rolls 3, 4 is twisted by means of the rotating spindle (not shown) and then wound onto a bobbin mounted on the spindle by means of a ring-and-traveler take-up mechanism (not shown).

The following experiments were conducted to demonstrate the advantages of the drafting apparatus of the invention.

EXAMPLE

In a first series of experiments, 70-grain per yard (4.9 grams per meter) silver composed of nylon 66 carpets staple fibers having a length of 7½ inches (19.05 cm), a denier of 15 and an average of 9 crimps per inch (354 cpm) is converted on a conventional Whitin NW ring spinning frame position to provide 3½ cotton count staple yarn having 4½ (177 tpm) of twist in the Z-direction. The spindle is operated at 5500 rpm, the peripheral speed of the front rolls is adjusted to provide the above amount of twist and the peripheral speed of the rear rolls is adjusted to provide a draft ratio of about 25:1. A condenser, through which the sliver passes, is positioned between the drafting control aprons and front rolls in a conventional manner. When the peripheral speed of the rear rolls is adjusted to provide a draft ratio of 28:1, noticeable thick/thin regions then appear along the length of the sliver at the front rolls. As the draft ratio is gradually increased by further reducing the peripheral speed of the rear rolls, the thick/thin regions become increasingly more noticeable and at a ratio of about 30:1 the sliver breaks at the front rolls. Further attempts to run the sliver under these conditions is unsuccessful.

In a second series of experiments, the above experiments are repeated except in this instance the drafting section of the NW Whitin frame is modified as shown in the FIGURE to include front cot roll apron 4'. In these experiments, sliver of acceptable uniformity in terms of thick and thin regions is obtained and the sliver does not break (position runs smoothly) even when the draft ratio is increased to 85:1. It appears from these experiments that the draft ratio is limited only by the gearing of the machine (frame) being used and that higher draft ratios could be successfully used by merely changing the gearing of the machine.

In related experiments the drafting section of a conventional short staple ring spinning frame of the type used to provide apparel yarn is modified as shown in the FIGURE to include front cot roll apron 4' In these experiments several slivers composed of 100% cotton staple fibers and slivers composed of a 50/50 blend of cotton and polyester are processed to produce highly twisted yarns. The fibers of each of the slivers has a length in the range of ⅜ to 2 inches (1 to 5 cm). Results similar to those obtained above on the long staple Whitin NW ring spinning frame are also obtained in these experiments. Also, the physical properties (e.g. tenacity and Uster are improved) of the resulting yarn are improved.

It is apparent from the foregoing experiments that the drafting apparatus of the present invention can be used in several different ways, for example, to improve the performance or the economics of ring spinning frames and/or the quality and uniformity of staple yarn and/or provide new staple yarn products, such as finer counts.

I claim:

1. An improved apparatus for the drafting section of ring spinning frames on which sliver consisting of crimped staple fibers is simultaneously and continuously drafted, twisted and wound onto a bobbin, said apparatus comprising a pair of rear nip rolls for metering the input of sliver and a pair of front nip rolls for drafting sliver, each said pair consisting of a cot roll and a driven serrated metal roll, wherein the distance between the nip of said rear rolls and the nip of said front rolls is greater than the length of said staple fibers, drafting control means positioned between said rear nip rolls and said front nip rolls for guiding, controlling and straightening said fibers, a front cot roll apron extending around and in contact with said front cot roll and at least one other elongated member, said member(s) being positioned between said front cot roll and said drafting control means, said member(s) and said front cot roll being of a size and arranged with respect to one another so that said front cot roll apron follows the contour of said front metal roll.

2. The apparatus of claim 1 wherein said drafting control means is a pair of rotatable aprons.

3. The apparatus of claim 2 wherein said frame is a short staple frame.

4. The apparatus of claim 2 wherein said frame is a long staple frame.

5. In a ring spinning process wherein sliver consisting of loosely assembled crimp staple fibers is (1) drafted by passing the sliver between two pair of nip rolls, a back pair and a front pair, each pair having a cot roll and a serrated metal roll, the distance between said two pair of rolls being slightly greater than the length of said fibers, wherein the sliver en route from said back rolls to said front rolls passes first between and in contact with a pair of rotating aprons having peripheral speeds slightly greater than that of said back rolls and then through a free floating condenser position between said aprons and said front rolls, (2) twisted by means of an upright rotating spindle, and finally (3) wound onto a bobbin mounted on said spindle by means of a ring-and-traveler take-up mechanism, the improvement comprising passing the sliver from said condenser into contact with an apron which guides said sliver into the nip of said front rolls, wherein said apron rotates around the front cot roll and at least one elongated member, said member being positioned between said condenser and said front cot roll such that said apron follows the contour of said front serrated metal roll and presses said sliver against said front serrated metal roll and said apron with a compressive force that permits said fibers to be straightened out and to slip without being stretched in a region between said pair of rotating aprons and said nip of said front rolls, whereby spinning performance in terms of ends down per 1000 spindle hours and yarn uniformity in terms of thick and thin regions and draft ratios in excess of 28:1 may be used without sacrificing acceptable spinning performance or yarn uniformity.

6. The process of claim 5 wherein said crimped staple fibers are short staple fibers.

7. The process of claim 5 wherein said crimped staple fibers are long staple fibers.

* * * * *